US010065221B2

(12) United States Patent
Wojciechowski, III et al.

(10) Patent No.: US 10,065,221 B2
(45) Date of Patent: Sep. 4, 2018

(54) SPRAY CLEANER HEAD

(71) Applicant: NLB Corp., Wixom, MI (US)

(72) Inventors: Donald Anthony Wojciechowski, III, Redford, MI (US); Matthew O. Herhold, Fenton, MI (US)

(73) Assignee: NLB CORPORATION, Wixom, MI (US)

( * ) Notice: Subject to any disclaimer, the term of this patent is extended or adjusted under 35 U.S.C. 154(b) by 230 days.

(21) Appl. No.: 13/930,448

(22) Filed: Jun. 28, 2013

(65) Prior Publication Data

US 2015/0001314 A1 Jan. 1, 2015

(51) Int. Cl.

| | |
|---|---|
| ***B08B 9/093*** | (2006.01) |
| ***B05B 3/00*** | (2006.01) |
| ***B05B 3/06*** | (2006.01) |
| ***B05B 13/06*** | (2006.01) |

(52) U.S. Cl.

CPC ..... *B08B 9/0936* (2013.01); *B05B 3/006* (2013.01); *B05B 3/06* (2013.01); *B05B 13/0636* (2013.01)

(58) Field of Classification Search

CPC ..... B05B 3/006; B08B 9/0936; B08B 9/093; B08B 9/0933

USPC ..... 239/461, 264, 252, 451, 457, 458, 259, 239/251, 243, 242, 225.1, 227; 188/268

See application file for complete search history.

(56) References Cited

U.S. PATENT DOCUMENTS

| | | | | |
|---|---|---|---|---|
| 2,661,241 | A * | 12/1953 | Veneziano | 239/227 |
| 3,052,574 | A * | 9/1962 | Kennedy, Jr. | B05B 3/005 134/112 |
| 3,637,138 | A * | 1/1972 | Rucker | B05B 3/0445 239/227 |
| 3,902,670 | A * | 9/1975 | Koller et al. | 239/227 |
| 5,947,387 | A * | 9/1999 | Zink et al. | 239/227 |
| 6,460,553 | B1 * | 10/2002 | Owens | B05B 3/0445 134/167 R |
| 6,561,199 | B2 * | 5/2003 | Gleeson | B05B 3/0445 134/167 R |
| 2007/0000741 | A1 * | 1/2007 | Pribonic et al. | 188/267 |

* cited by examiner

*Primary Examiner* — Alexander Valvis
*Assistant Examiner* — Tuongminh Pham
(74) *Attorney, Agent, or Firm* — Carlson, Gaskey & Olds, P.C.

(57) ABSTRACT

This disclosure relates to a spray cleaner head for a cleaning system. In one aspect of this disclosure, the spray cleaner head includes a gear system configured to regulate rotation of a nozzle, and the gear system includes a central bore receiving an inlet shaft. In another aspect of this disclosure, spray cleaner head includes an adjustable brake assembly configured to selectively regulate rotation of the nozzle. In yet another aspect of this disclosure, the spray cleaner head includes first and second seals provided axially between the first and second bearings.

14 Claims, 8 Drawing Sheets

SPRAY CLEANER HEAD

BACKGROUND

The present disclosure relates to a spray cleaner head having at least two axes of rotation. Spray cleaner heads having multiple axes of rotation are generally known. One such example is present in U.S. Pat. No. 8,382,915, assigned to NLB Corp.

Such spray cleaner heads are particularly useful for cleaning concrete mixer drums. During use of a concrete mixer drum, residual concrete eventually cures and hardens within the mixer drum, which increases the apparent weight of the mixer drum and lowers the liquid concrete capacity of the drum. The spray cleaner heads are configured to direct a relatively high pressure stream of fluid throughout the interior of the mixer drum to clean liquid and solid concrete from the interior of the mixer drum.

SUMMARY

In one aspect of this disclosure, a spray cleaner head includes at least one nozzle rotatable about a first axis and a second axis. The spray cleaner head further includes an inlet shaft provided along the first axis. The inlet shaft is in fluid communication with the at least one nozzle. The spray cleaner head also includes a gear system configured to regulate rotation of the nozzle. The gear system includes a central bore receiving the inlet shaft.

In another aspect of this disclosure, a spray cleaner head includes a nozzle rotatable about a first axis and a second axis. The spray cleaner head further includes an adjustable brake assembly configured to selectively regulate rotation of the nozzle.

In yet another aspect of this disclosure, a spray cleaner head for a cleaning system includes an inlet shaft provided about a first axis, and an outlet shaft provided about a second axis. The outlet shaft has at least one orifice therein. The at least one orifice is in fluid communication with an outlet of the inlet shaft. A first seal and a second seal are provided on opposite axial sides of the at least one orifice.

These and other features of the present disclosure can be best understood from the following drawings and detailed description.

BRIEF DESCRIPTION OF THE DRAWINGS

The drawings can be briefly described as follows.

DETAILED DESCRIPTION

Figure 1:
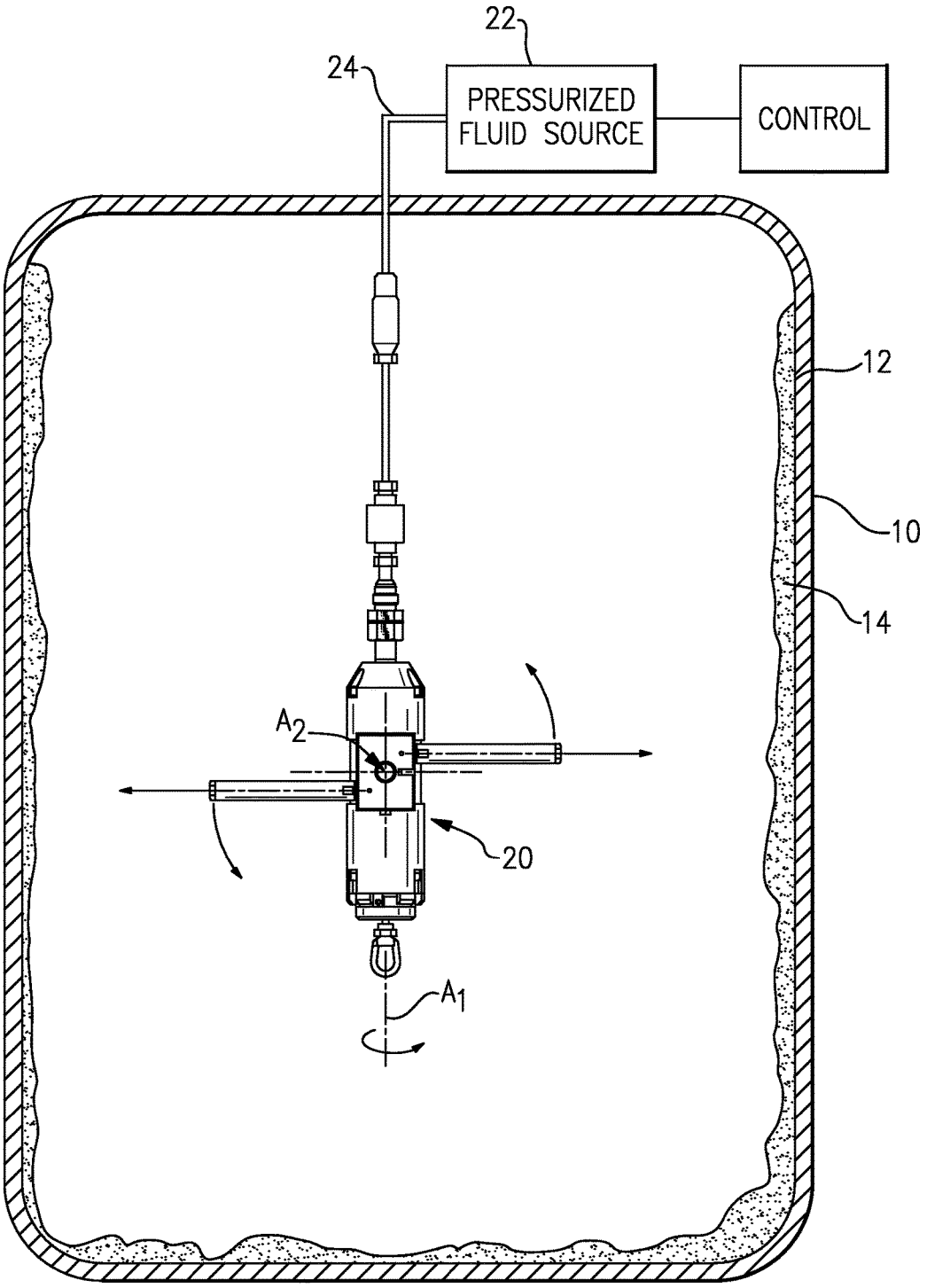
FIG. 1 is a view of a spray cleaner head according to this disclosure arranged in a vessel.

FIG. 1 illustrates a vessel 10, which in one example is a mixer drum of a concrete mixer. This disclosure is not limited to use with mixer drums for concrete mixers, however. Instead, this disclosure extends to any type of vessel.

In one example, an interior surface 12 of the vessel 10 is substantially covered by hardened concrete 14. To remove the hardened concrete 14 from the interior surface 12 of the vessel 10, a spray cleaner head 20 according to this disclosure is arranged inside the vessel 10. The spray cleaner head 20 is in communication with a pressurized fluid source 22 via a fluid line 24. The pressurized fluid source 22 in one example is in communication with a control, such as a computer, configured to control operation of the pressurized fluid source 22. The control may be a mechanical control, however, such as a valve (or series of valves).

As will be explained in detail below, fluid from the pressurized fluid source 22 is configured to be ejected from the spray cleaner head 20 to clean the inside of the vessel 10. The pressurized fluid further is configured to rotate the spray cleaner head 20 about a first axis of rotation A1, or inlet axis of rotation, and a second axis of rotation A2, or an outlet axis of rotation.

Figure 2:
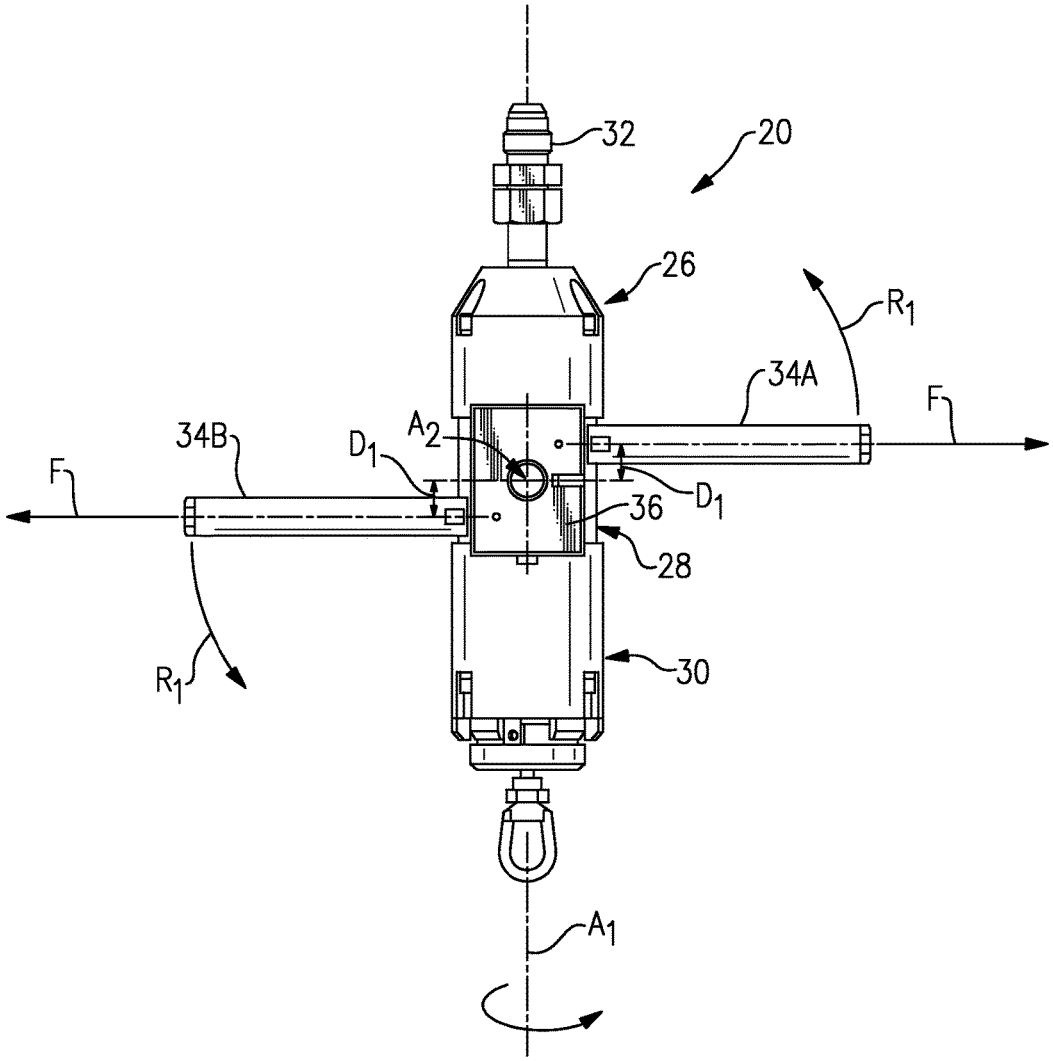
FIG. 2 illustrates the disclosed spray cleaner head.

FIG. 2 illustrates the spray cleaner head 20. Generally, the spray cleaner head 20 includes an inlet housing assembly 26, a hub assembly 28, and a brake housing assembly 30, each of which are arranged along the first axis of rotation A1. The hub assembly 28 is positioned between axial ends of the inlet housing assembly 26 and the brake housing assembly 30. The spray cleaner head 20 further includes an inlet shaft 32 configured to receive a flow of pressurized fluid from the pressurized fluid source 22 (FIG. 1). The flow of fluid is routed from the inlet shaft 32 to at least one of the nozzle 34A, 34B, via an outlet shaft 33 and the nozzle block 36 (see FIGS. 3-5). In this example, there are two nozzles 34A, 34B configured to expel the fluid from the spray cleaner head 20. The nozzles 34A, 34B are arranged on a nozzle block 36 which is configured to rotate about the second axis of rotation A2. As will be appreciated from the below, the nozzle block 36 is configured to rotate about the first axis of rotation A1 as well.

Each of the nozzles 34A, 34B are offset from the second axis A2 by a distance D1. As high pressure fluid is directed to the nozzles 34A, 34B, the fluid F is expelled outwardly, and generates a thrust, by virtue of the offset distances D1. This translates into rotation of the nozzle block 36 in a generally counter clockwise rotational direction R1 relative to FIG. 2.

Figure 3:
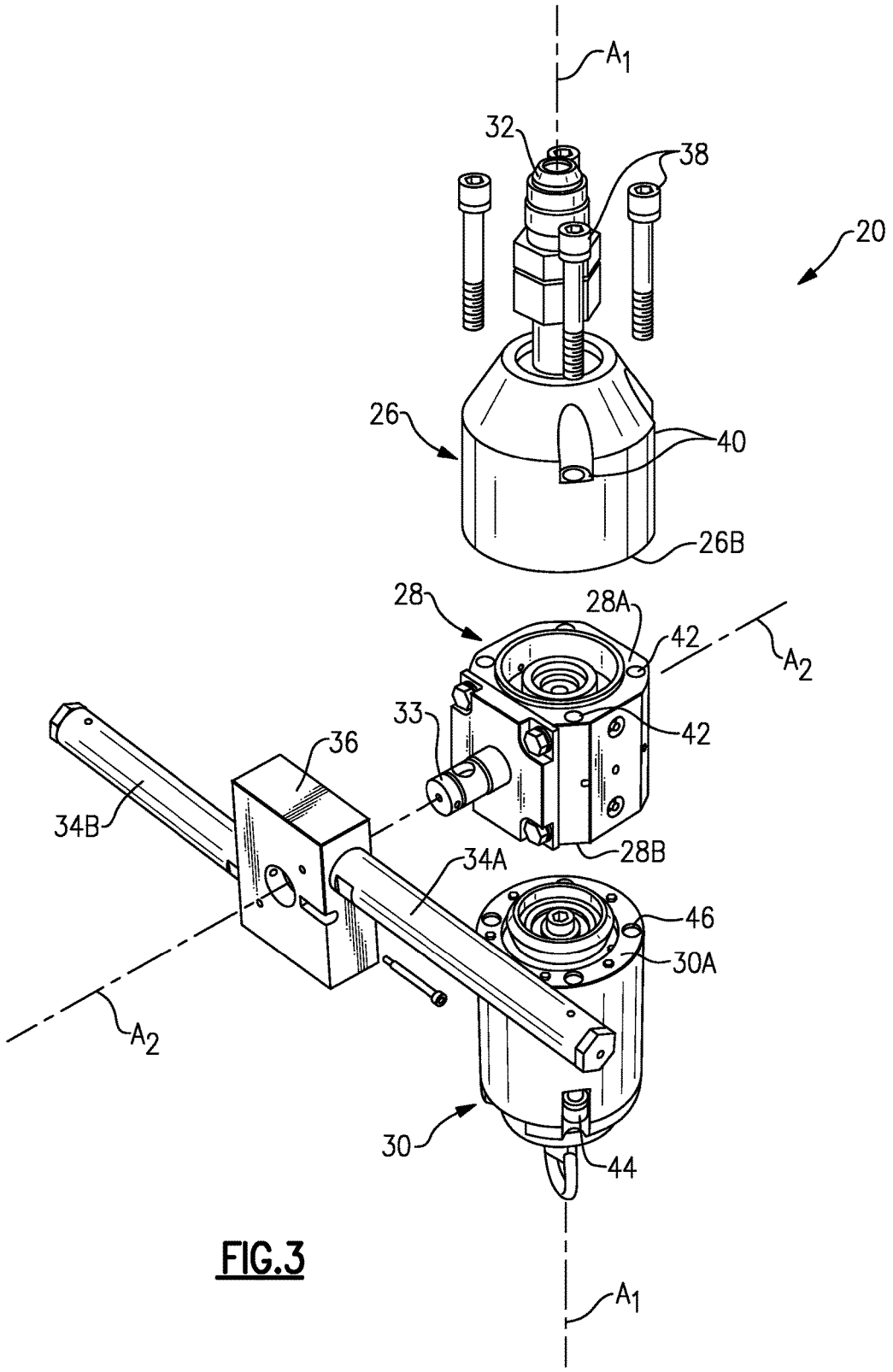
FIG. 3 is an exploded view of the disclosed spray cleaner head.

Referring to FIG. 3, the detail of the arrangement of the inlet housing assembly 26, the hub assembly 28, and the magnetic brake assembly 30 is illustrated. In this example, a bottom surface 26B of the inlet housing assembly 26 is directly fastened to the top surface 28A of the hub assembly 28. A plurality of fasteners 38 are provided through holes 40 in the inlet housing assembly 26, and threadably engage with corresponding holes 42 in the hub assembly 28. Similarly, a bottom surface 28B of the hub assembly 28 is directly fastened to the top surface 30A of the brake housing assembly 30 by way of a plurality of fasteners 44. The fasteners 44 extend through holes 46 in the brake housing assembly 30 and are threadably engaged with corresponding holes in the hub assembly 28.

In this example, there are four fasteners 38 and four fasteners 44 connecting the inlet housing assembly 26, the hub assembly 28, and the brake housing assembly 30. It should be understood that any desired number of fasteners could be used, however. Using the disclosed arrangement, the inlet housing assembly 26, the hub assembly 28, and the brake housing assembly 30 are relatively easily disassembled from one another. This allows the inner workings of the hub assembly 28 (e.g., seals, gears, etc.) to be conveniently accessed for repair or replacement simply by removing the fasteners 38, 44.

Figure 4:
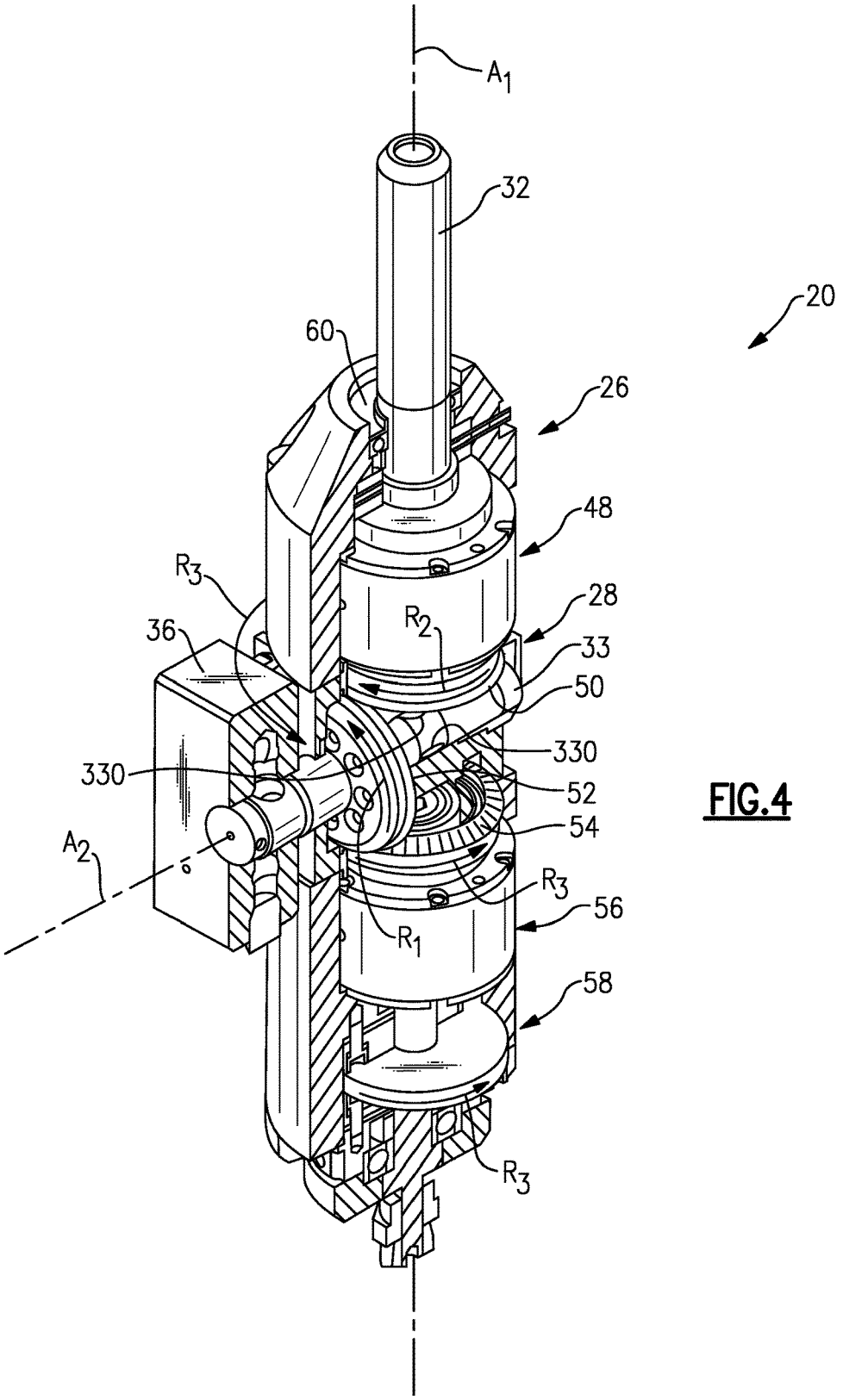
FIG. 4 is a sectional view of the disclosed spray cleaner head, and illustrates the detail of the interior of the spray cleaner head.

FIG. 4 is a sectional view of the spray cleaner head 20. As illustrated, the inlet housing assembly 26 encloses a speed reduction gear system 48. The detail of the speed reduction gear system 48 will be explained below. An inlet miter gear 50 is engaged with the speed reduction gear system 48 and an outlet miter gear 52. The outlet miter gear 52 is configured to rotate with rotation of the output shaft 33 and the nozzle block 36. The outlet miter gear 52 is further engaged with a brake miter gear 54, which in turn is engaged with a speed increase gear system 56 and the brake assembly 58. The detail of the speed increase gear system 56 and the brake assembly 58 will be discussed in detail below.

As illustrated in FIG. 1, the inlet shaft 32 is directly fastened to the fluid line 24. The fluid line 24 in one example is a relatively rigid line that is not configured for rotation. Accordingly, during operation of the spray cleaner head 20, the inlet shaft 32 does not rotate about the axis A1. Instead, as water is expelled outward from the nozzles 34A, 34B, the rotation about the axis A2 in the rotational direction R1 drives the outlet miter gear 52 in the rotational direction R1. The outlet miter gear 52 in turn drives the inlet miter gear 50 in a rotational direction R2 about the axis A1. The inlet miter gear 50 then drives the speed reduction gear system 48, which causes rotation the inlet housing assembly 26 about the axis A1. In one example, the inlet housing assembly 26, the hub assembly 28, and the brake housing assembly 30 rotate in a direction R3 generally opposite to the direction R2 relative to the inlet shaft 32 (which, again, is not configured to rotate about the axis A1 in this example). As will be explained in detail below, the brake assembly 58 is configured to be selectively adjusted to regulate rotation nozzle block about the axis A2 and the spray cleaner head about the axis A1.

Figure 5:
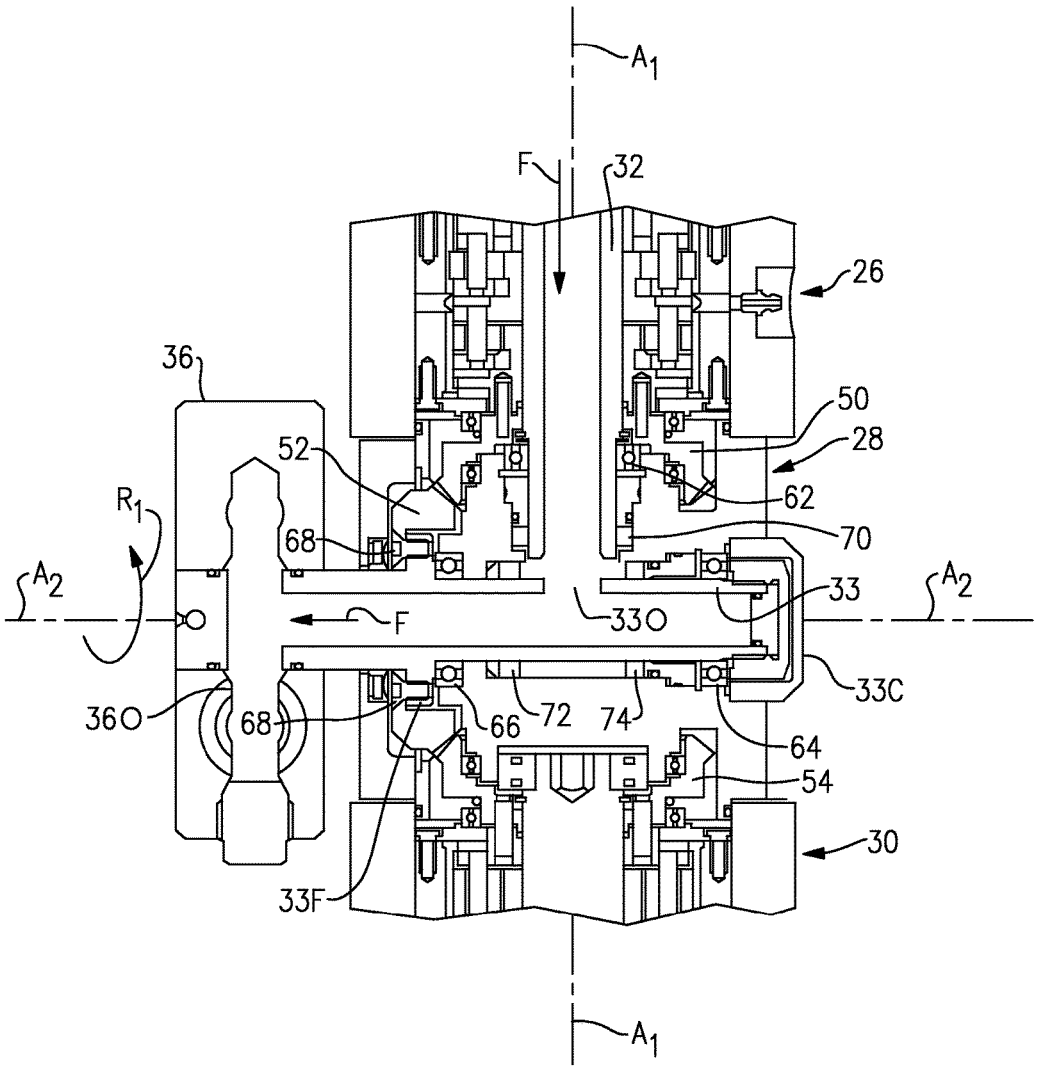
FIG. 5 is another sectional view of the disclosed spray cleaner head, illustrating the detail of the inlet housing assembly and hub assembly.

The spray cleaner head 20 is generally configured to rotate about the axis A1 (relative to the inlet shaft 32), as generally explained above, by way of a first radial bearing 60, shown in FIG. 4, and a second radial bearing 62, shown in FIG. 5. These radial bearings 60, 62 are provided adjacent opposite axial ends of the inlet shaft 32 and radially surround the inlet shaft 32 to allow rotation of the inlet housing assembly 26 about the inlet shaft 32. The radial bearings 60, 62 further provide support to the spray cleaner head 20, protecting the inlet shaft 32 from incidental damage, such as when the spray cleaner head 20 comes into unintentional contact with a wall of the vessel 10.

The outlet shaft 33 is likewise supported at axial ends thereof by radial bearings 64, 66. These radial bearings 64, 66 not only provide rotational support to the outlet shaft 33, but further provide the added feature of preventing incidental damage to the outlet shaft 33.

Turning to FIG. 5, a flow of fluid F is provided from a pressurized fluid source 22, via a high pressure line 24, to the inlet shaft 32. The flow of fluid F in this example is directed along the axis A1, down the inlet shaft 32, and toward the outlet shaft 33. The outlet shaft 33 includes a plurality of orifices 33O allowing the fluid F to enter the outlet shaft 33. The fluid F is then directed along the axis A2 toward the nozzle block 36. The nozzle block 36 includes orifices 36O therein to communicate the fluid F to the nozzles 34A, 34B. The outlet shaft 33 further includes a flange 33F that is fastened to the outlet miter gear 52 by way of fasteners 68, such that the output shaft 33 is rotatably fixed relative to the outlet miter gear 52.

The fluid intersection between the inlet shaft 32 and the outlet shaft 33 is sealed with a plurality of seals. For instance, a first seal 70 is provided at an axial end of the inlet shaft 32, at a point downstream of the bearing 62. Further, first and second seals 72, 74 are provided on opposite sides of the orifices 33O of the outlet shaft 33 at points axially between the bearings 64, 66, relative to the second axis A2. The first and second seals 72, 74 thus serve to contain the pressure from the fluid F flowing inside the spray cleaner head 20, which in turn reduces the load on the bearings 64, 66. These seals 70, 72, 74 are high pressure seals configured for use in applications where the spray cleaner head 20 is in communication with a high pressure fluid F. One example of these high pressure seals is disclosed in U.S. Pat. No. 8,251,301, assigned to NLB Corp., the entirety of which is herein incorporated by reference.

As noted above, the spray cleaner head 20 is easily assembled and disassembled because of the relatively low number of fasteners 38, 44. These fasteners can be removed, and the seals 70, 72, 74 can be replaced relatively quickly. Relative to the seals 72, 74 in particular, the output shaft 33 is maintained in position by an output shaft cover 33C which in turn is maintained in position by a plurality of fasteners (not shown). The output shaft cover 33C can be removed, and the seals 72, 74 can be accessed along the axis A2 (from the right relative to FIG. 5).

Figure 6A:
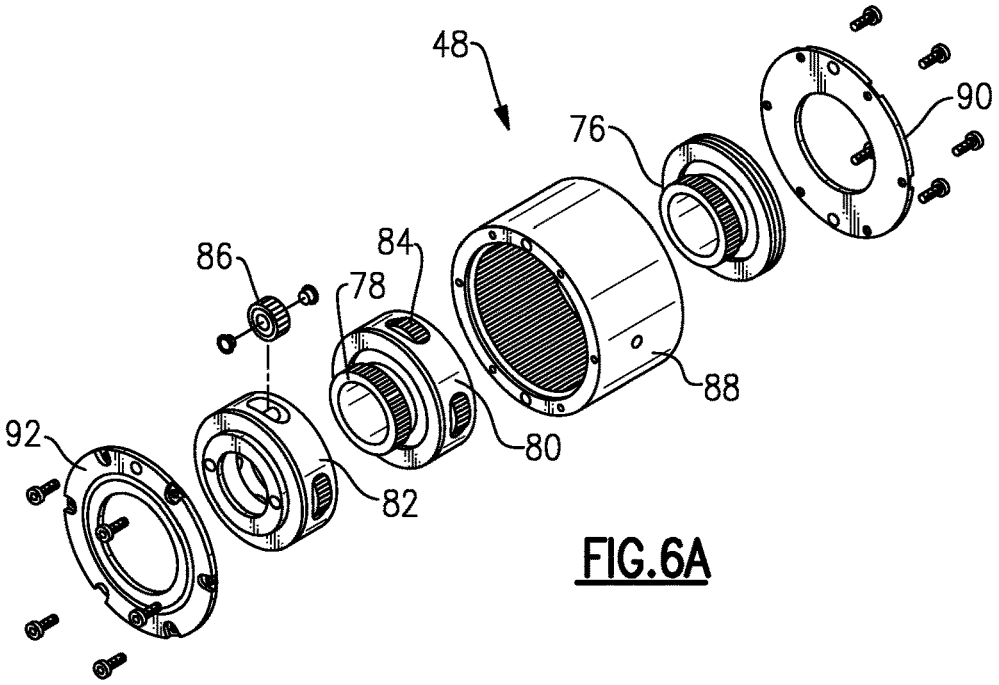
FIG. 6A is an exploded view of a gear drive system according to this disclosure.

FIG. 6A is an exploded view of the speed reduction gear system 48. The speed reduction gear system 48 includes first and second sun gears 76, 78; first and second carriers 80, 82; and first and second sets of star gears 84, 86; a ring gear 88, and end plates 90, 92 at axial ends thereof. It should be understood that the speed increase gear system 56 includes a similar arrangement.

Figure 6B:
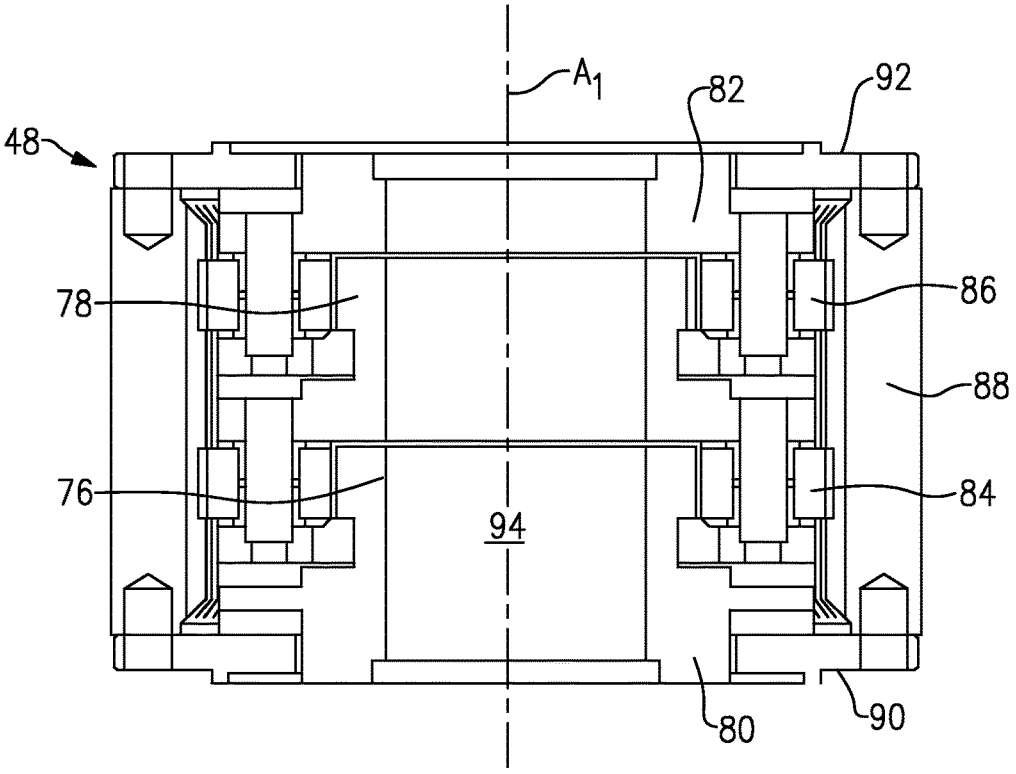
FIG. 6B is a sectional view of the disclosed gear drive system.

FIG. 6B illustrates a sectional view of the assembled speed reduction gear system 48. As illustrated in FIG. 6B, the speed reduction gear system 48 includes a central bore 94 axially therethrough, which is configured to be aligned along the first axis A1. The inlet shaft 32 is configured to be received in the central bore 94. Thus, the speed reduction gear system 48 takes up a relatively small amount of axial and radial space relative to prior nozzles, which do not include this central bore.

The speed reduction gear system 48 is further configured to regulate rotation of the nozzle block 36 in the direction R1 and further regulate rotation of the spray cleaner head 20 in the direction R3. In one example, the speed reduction gear system 48 is configured such that the jets expelled from the nozzles 34A, 34B do not cover the same path on an interior 12 of the vessel 10 within too short a time.

In one example, a ratio of rotations of the spray cleaner head 20 around the axis A1 (in rotational direction R3) to rotations of the nozzle block 36 about the axis A2 (in rotational direction R1) is at least 1 to 7.9. In one particular example, the ratio is 1 to 7.942. Other ratios come within the scope of this disclosure, however. For instance, while the speed reduction gear system 48 is a two-stage gear system, a three stage gear system could provide a ratio on the order of 1 to 22. Depending on the particular application, an appropriate ratio can be selected to ensure that the spray cleaner head 20 does not overlap the same cleaning path too soon in the cleaning cycle, which in turn can lead to inefficient cleaning (sometimes known as "striping"). It may be important, in some examples, to consider how evenly the ratio is divided into the number 360 (e.g., whether 360 divided by the ratio—for instance 7.9—would provide an even result). If the result is a whole number, then the striping may be more likely to occur.

As will be explained below, a brake assembly can be adjusted to change the rotational speed of the nozzles 34A, 34B. As this speed is adjusted, the speed reduction gear system 48 is configured to maintain a substantially constant ratio. This provides the same, efficient level of nozzle coverage regardless of rotational speed.

Figure 7:
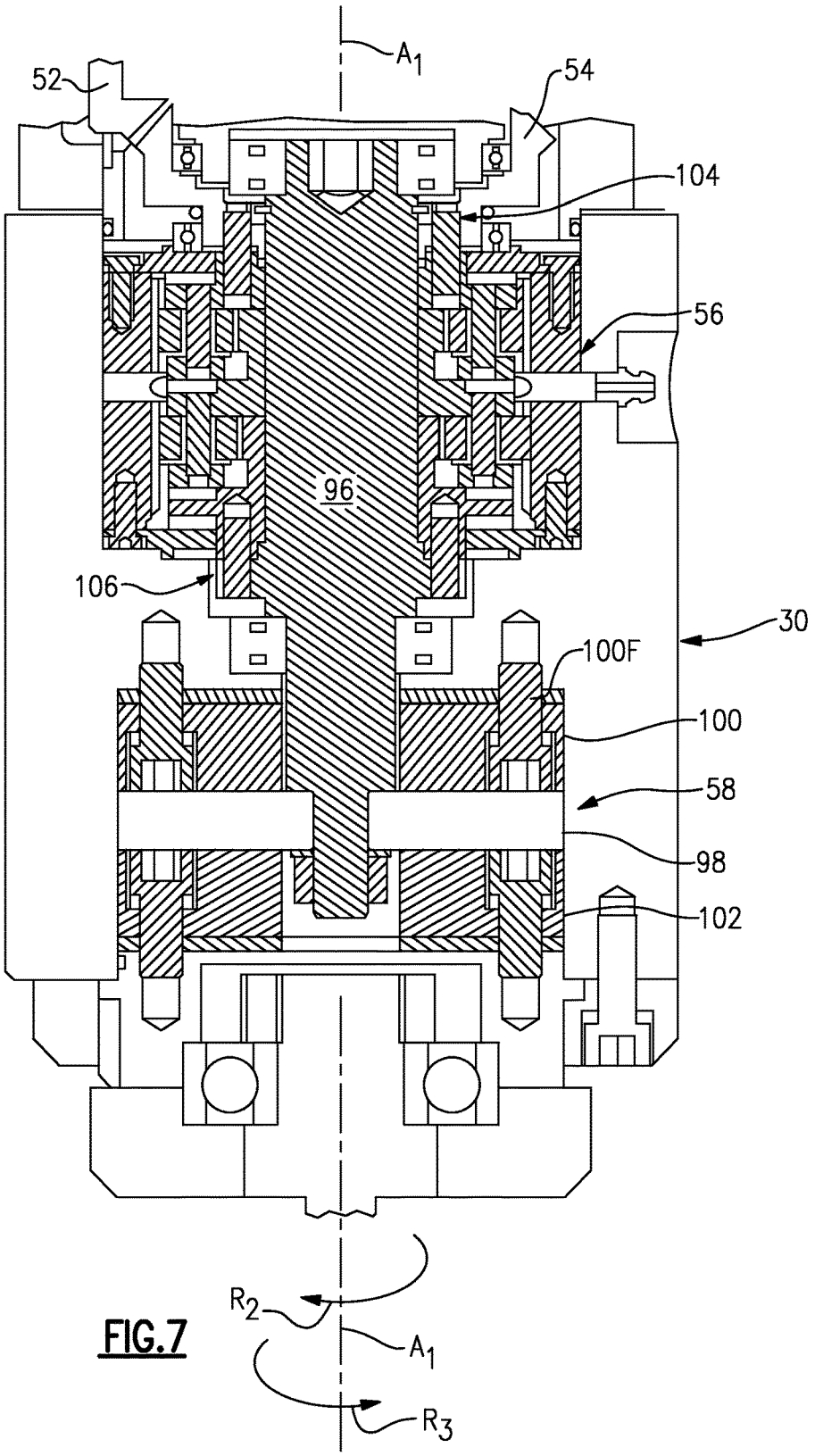
FIG. 7 is a sectional view of the disclosed spray cleaner head, and illustrates the detail of the brake assembly.

As noted relative to FIG. 4, rotation of the outlet miter gear 52 is also regulated by the brake miter gear 54. The brake miter gear 54, as illustrated in FIG. 7, is engaged with a speed increase gear system 56, a brake assembly shaft 96, and the brake assembly 58.

The brake assembly 58 generally includes a rotor 98 and first and second axially opposed stators 100, 102. As illustrated, the rotor 98 is coupled to the brake shaft 96. The rotor 98 is configured to be rotated about the axis A1 in a direction R3, with rotation of the brake miter gear 54. In one example, the speed of rotation of the rotor 98 is faster than rotation of the brake miter gear 54. The speed increase gear system 56 provides this speed differential by way of the arrangement of the speed increase gear system 56 relative to the brake shaft 96.

In particular, the brake miter gear 54 is coupled to the speed increase gear system 56 (generally illustrated at a point 104), whereas the brake shaft 96 is coupled to the speed increase gear system 56 at an opposite axially axial end (generally illustrated at point 106) of the speed increase gear system 56. The speed increase gear system 56 is arranged substantially similar to the speed reduction gear system 48. Accordingly, for the sake of brevity, the arrangement is not repeated herein.

As the outlet miter gear 52 rotates, the rotation of the outlet miter gear 52 translates into rotation of the rotor 98. Rotation of the rotor 98 can be resisted in various levels based on the relative arrangement of the stators 100, 102.

In one example, the stator 100 is fixed relative to the brake housing assembly 30 via a plurality of fasteners 100F. On the other hand, the stator assembly 102 is capable of being rotated within an angular range, in one example approximately 30 degrees, to provide an adjustable braking force, as will be explained below.

Figure 8:
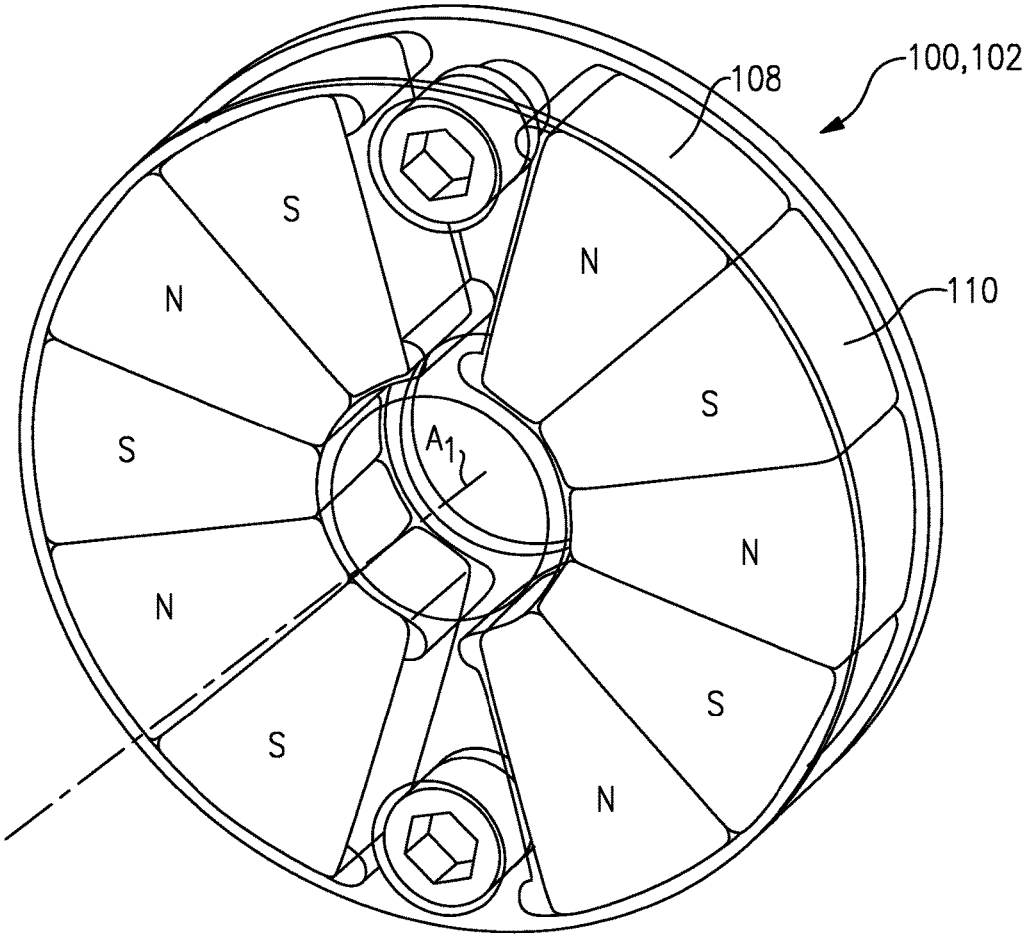
FIG. 8 illustrates an example stator according to this disclosure.

In one example, the rotor 98 is a metallic material, such as copper, that is responsive to a magnetic force. Further, the stators 100, 102 each include a plurality of magnets 108, 110, arranged circumferentially in an alternating north pole (e.g., 108) and south pole pattern (e.g., 110) as illustrated in FIG. 8. Accordingly, the stator assembly 102 is capable of being rotated relative to the stator 100 to either align magnets 108, 110 to provide a desired magnetic force therebetween, and thus a desired braking level.

In a minimum braking position, a minimum braking force is provided when the magnets 108, 110 of the stator 100 axially face magnets 108, 110 having like poles (e.g., north pole magnets 108 of the stator 100 axially face north pole magnets 108 of the stator 102, and vice versa). This creates a magnetic opposing force between the stators 100, 102. On the other hand, in a maximum braking position, the stators 100, 102 are aligned such that the opposite poles axially face one another (e.g., north pole magnets 108 of the stator 100 axially face south pole magnets 110 of the stator 102, and vice versa). This creates a magnetic attraction force between the stators 100, 102, which in turn resists rotation of the rotor 98.

There may further be one or more intermediate positions (between the minimum and maximum braking positions), which provide an intermediate level of braking, between the minimum and maximum braking positions. A user can select an appropriate braking level depending on the desired application.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A spray cleaner head for a cleaning system, comprising:

a first nozzle and a second nozzle rotatable about a first axis and a second axis, wherein the first and second axes are substantially perpendicular to one another and intersect one another; an inlet shaft provided along the first axis, the inlet shaft being in fluid communication with the first and second nozzles; and a gear system configured to regulate rotation of the first and second nozzles, the gear system including a central bore receiving the inlet shaft, wherein the inlet shaft passes through a space radially inward of at least one gear of the gear system; wherein the first and second nozzles are offset from both the first axis and the second axis such that a flow of fluid through the first and second nozzles rotates the first and second nozzles about the first and second axes, wherein an initial start of the rotation of the first and second nozzles about the first and second axes is driven only by fluid flowing through the first and second nozzles, wherein each of the first nozzle and the second nozzle extends in a respective longitudinal direction substantially perpendicular to second axis, wherein the first nozzle and the second nozzle are provided on opposite sides of the second axis and are spaced-apart from the second axis such that the longitudinal directions do not intersect the second axis.

2. The spray cleaner head as recited in claim 1, including an outlet shaft in fluid communication with the inlet shaft, the outlet shaft provided along the second axis.

3. The spray cleaner head as recited in claim 2, including a nozzle block in fluid communication with the first and second nozzles and the outlet shaft, the nozzle block configured to rotate with the first and second nozzles and the outlet shaft.

4. The spray cleaner head as recited in claim 2, wherein, when fluid flows through the first and second nozzles, the gear system is configured to regulate rotation of the first and second nozzles such that a ratio of rotations of the first and second nozzles about the second axis to the first axis is at least 5 to 1.

5. The spray cleaner head as recited in claim 4, wherein, when fluid flows of fluid through the first and second nozzles, the ratio of rotations of the first and second nozzles about the second axis to the first axis is at least 7 to 1.

6. The spray cleaner head as recited in claim 1, including an inlet housing assembly, a brake housing assembly, and a hub assembly mounted between axial ends of the inlet housing assembly and the brake housing assembly, each of the inlet housing assembly, the brake housing assembly, and the hub assembly oriented about the first axis.

7. The spray cleaner head as recited in claim 6, wherein the inlet housing assembly and the brake housing assembly are fastened to the hub assembly by way of a plurality of fasteners, the fasteners extending in a direction substantially parallel to the first axis.

8. The spray cleaner head as recited in claim 1, wherein the first axis is substantially perpendicular to the second axis.

9. A spray cleaner head for a cleaning system, comprising: a nozzle rotatable about a first axis and a second axis, wherein an initial start of rotation of the nozzle is driven only by fluid flowing through the nozzle, wherein the first and second axes are substantially perpendicular to one another and intersect one another; an inlet shaft provided along the first axis and being in fluid communication with the nozzle; an adjustable brake assembly configured to selectively regulate rotation of the nozzle, wherein the adjustable brake assembly includes a rotor axially between a first stator and a second stator, wherein the rotor is made of a conductive material and is configured to rotate in response to rotation of the nozzle, wherein the first stator and the second stator each include a plurality of magnets, and wherein the first stator is rotatable relative to the second stator to change a magnetic force acting upon the rotor; and wherein a speed of rotation of the nozzle is influenced by a first set of gears on a first side of the second axis, and wherein the speed of rotation of the nozzle is influenced by a second set of gears on a second side of the second axis opposite the first side, wherein the adjustable brake assembly includes a shaft coupled to the second set of gears and the rotor.

10. A spray cleaner head for a cleaning system, comprising: an inlet shaft provided about a first axis; an outlet shaft provided about a second axis perpendicular to the first axis, the outlet shaft having at least one orifice therein, the at least one orifice in fluid communication with an outlet of the inlet shaft, wherein the first and second axes are substantially perpendicular to one another and intersect one another; a first seal and a second seal provided on opposite axial sides of the at least one orifice, the first seal spaced-apart from the second seal along the second axis, wherein the first and second seals are disposed circumferentially about the outlet shaft; and a first nozzle and a second nozzle rotatable about the first and second axes, wherein the first and second nozzles are offset from both the first axis and the second axis such that a flow of fluid through the first and second nozzles rotates the first and second nozzles about the first and second axes, wherein an initial start of the rotation of the first and second nozzles about the first and second axes is driven only by fluid flowing through the first and second nozzles.

11. The spray cleaner head as recited in claim 10, including:

a first bearing adjacent one axial end of the outlet shaft, and a second bearing adjacent another axial end of the outlet shaft, the first bearing and the second bearing radially supporting the outlet shaft, wherein the first seal and the second seal are provided axially between the first and second bearings; and a third bearing adjacent one axial end of the inlet shaft, and a fourth bearing adjacent another axial end of the inlet shaft, the third bearing and the fourth bearing radially supporting the inlet shaft.

12. The spray cleaner head as recited in claim 11, including:

a third seal provided about the inlet shaft adjacent the third bearing, wherein the first, second, and third seals seal a fluid intersection between the inlet shaft and the outlet shaft, and wherein the third seal is disposed circumferentially about the inlet shaft.

13. The spray cleaner head as recited in claim 1, wherein the first axis is perpendicular to the second axis.

14. The spray cleaner head as recited in claim 9, further comprising a gear system configured to regulate rotation of the nozzle, the gear system including a central bore receiving the inlet shaft, wherein the inlet shaft passes through a space radially inward of at least one gear of the gear system.

* * * * *